US007152423B2

(12) United States Patent
Schmitz

(10) Patent No.: US 7,152,423 B2
(45) Date of Patent: Dec. 26, 2006

(54) REFRIGERATING DEVICE FOR STORING AND PRESENTING ICE CREAM

(76) Inventor: Guido Schmitz, 654 W. Mountain Rd., Sparta, NJ (US) 07871

( * ) Notice: Subject to any disclaimer, the term of this patent is extended or adjusted under 35 U.S.C. 154(b) by 0 days.

(21) Appl. No.: 10/801,094

(22) Filed: Mar. 15, 2004

(65) Prior Publication Data

US 2005/0000237 A1 Jan. 6, 2005

(30) Foreign Application Priority Data

Mar. 13, 2003 (DE) ..... 103 10 919

(51) Int. Cl.
*A47F 3/04* (2006.01)

(52) U.S. Cl. ..... 62/250; 62/457.9

(58) Field of Classification Search ..... 62/342, 62/343, 419, 426, 246–256, 457.1–457.9
See application file for complete search history.

(56) References Cited

U.S. PATENT DOCUMENTS

| | | | | |
|---|---|---|---|---|
| 1,609,915 A * | 12/1926 | Parker | 62/162 |
| 2,541,814 A * | 2/1951 | Gaddini | 62/136 |
| 2,555,624 A * | 6/1951 | Anderson | 62/342 |
| 2,599,032 A * | 6/1952 | Widen | 49/80.1 |
| 3,952,538 A * | 4/1976 | Warlick | 62/342 |
| 4,450,692 A * | 5/1984 | Sharpe et al. | 62/233 |
| 4,573,329 A | 3/1986 | Cavalli | 62/342 |
| 6,370,798 B1 * | 4/2002 | Gonzalez, Sr. | 34/595 |

FOREIGN PATENT DOCUMENTS

| | | |
|---|---|---|
| DE | 87 17 307 U1 | 8/1988 |
| DE | 40 06 272 A1 | 9/1991 |

* cited by examiner

*Primary Examiner*—William E. Tapolcai
(74) *Attorney, Agent, or Firm*—Grossman Tucker Perreault & Pfleger PLLC

(57) ABSTRACT

The invention relates to a refrigerating device 1 for storing and presenting ice cream, with a heat-insulating housing 2, where housing 2 displays a housing opening 3 and a storage device 4 with a receiving compartment 5 for ice cream, where housing 2 essentially surrounds receiving compartment 5 completely and storage device 4 is mounted in housing 2 in rotating fashion, and where a heat exchanger 6 for generating cold air is assigned to housing 2 and can be connected to a refrigerating unit 7 located inside or outside housing 2, such that the ice cream in receiving compartment 5 can be refrigerated by the cold air generated. The invention is characterized in that storage device 4 is designed as an insert 9 that can be fitted and/or removed through housing opening 3. Insert 9 according to the invention is particularly characterized in that ice cream receiving compartment 5 is filled with unwrapped ice cream, at least in the area of adjacent delimiting walls 21.

19 Claims, 4 Drawing Sheets

Figures 1A, 1B:
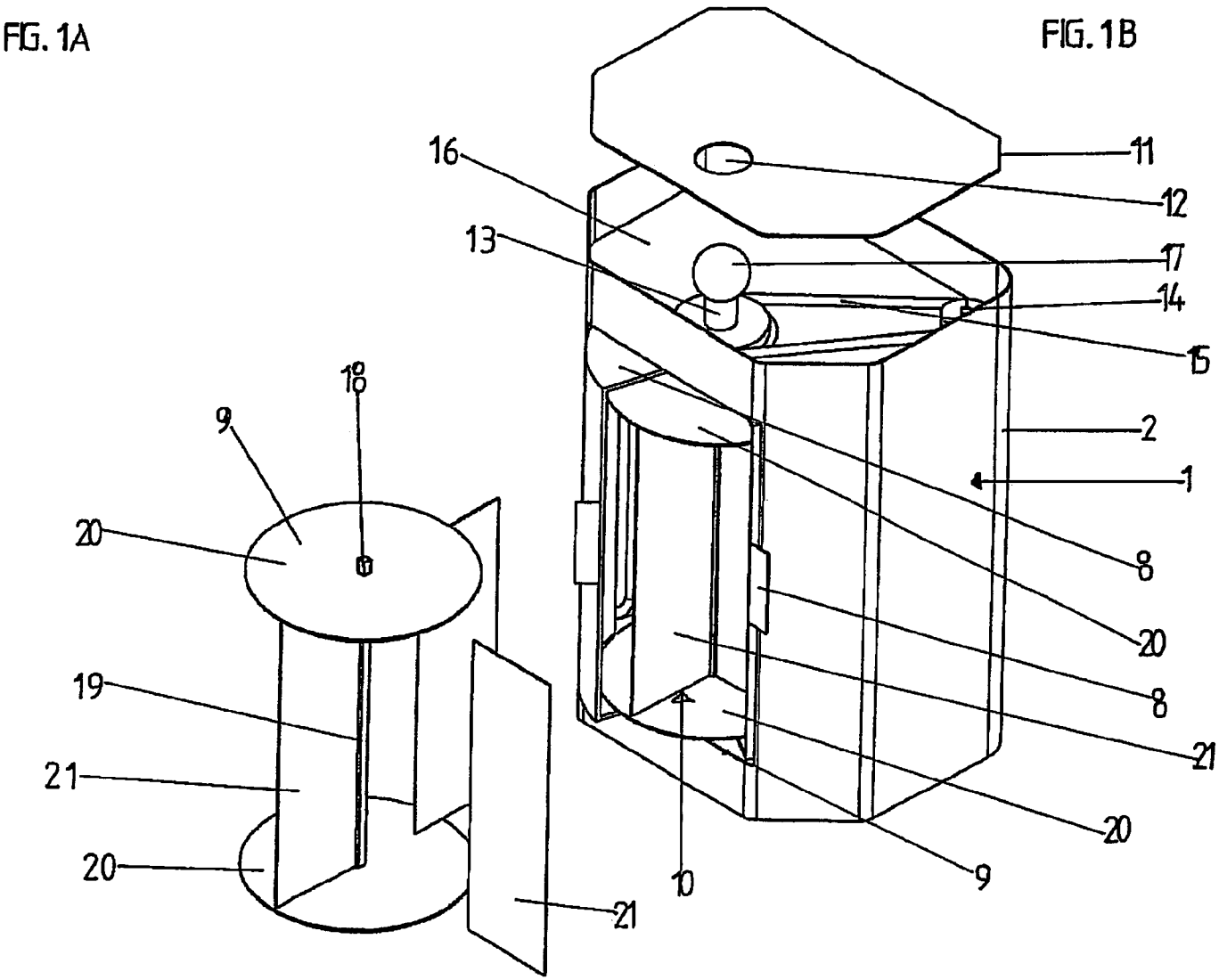

11
12
17
14
15
2
1
8
20
8
21
20
9
10
16
13

21
18
9
20
19
21
20

REFRIGERATING DEVICE FOR STORING AND PRESENTING ICE CREAM

The invention relates to a refrigerating device for storing and presenting ice cream, with a heat-insulating housing, where the housing displays a housing opening and a storage device with a receiving compartment for ice cream, where the housing essentially surrounds the receiving compartment completely and the storage device is mounted in the housing in rotating fashion, and where a heat exchanger for generating cold air is assigned to the housing and can be connected to a refrigerating unit located inside or outside the housing, such that the ice cream in the receiving compartment can be refrigerated by the cold air generated.

This type of refrigerating device is used for many applications, e.g. as a presentation device in ice cream parlors and as a presentation device of a buffet in the catering sector.

Refrigerating devices are known, in which the storage device for the ice cream is designed as a turntable, where the turntable is fixed by a bearing sleeve in a manner permitting rotation about a rising pipe running concentrically to the bearing sleeve. Refrigeration is achieved in that the cold air is first blown through the rising pipe by means of a fan, then falling over the turntable in the manner of an umbrella. Located on the turntable is pre-portioned ice cream, which can be arranged on, and removed from, the turntable through an opening in the housing. Filling of the turntable and removal of the ice cream is thus awkward and time-consuming, leading to only limited utilization of the capacity of the storage compartment supplied with cooling air.

Therefore, the object of the invention is to provide a refrigerating device for storing and presenting ice cream which, while offering attractive presentation of the ice cream, permits simple removal thereof and better utilization of the capacity of the refrigerated ice cream receiving compartment.

The object is solved in that the storage device is designed as an insert that can be fitted and/or removed through the housing opening. As a result, the insert can simply be removed from the housing for filling with ice cream, without having to at least largely dismantle the refrigerating device or the housing. The dismantled insert can then be filled with ice cream at a suitable location, e.g. in a kitchen. As a result, filling is no longer restricted to pre-portioned ice cream. Rather, the ice cream can, for example, be placed on the insert in blocks, directly at an ice cream machine, and the insert filled with ice cream can be stored in a cold store, without having to fear damage to, or destruction of the arrangement of, the pre-portioned units, as when transporting the insert with pre-portioned ice cream. At the same time, as a block located on the insert, the unwrapped ice cream is presented attractively due to the rotating design of the insert. Furthermore, the capacity of the coolable ice cream receiving compartment can be utilized better as a result of loading the insert with a block of ice cream. The object is furthermore solved by an insert, which can be used for a refrigerating device according to the invention.

Advantageous developments are revealed in the subclaims.

The rotating insert is preferably driven by a drive unit, with a transmission device and/or a gearbox where appropriate, where the drive unit and the transmission device and/or the gearbox are particularly preferably integrated in the housing. Rotation of the insert can take place permanently or, independently of the removal of ice cream, intermittently.

The axis of rotation of the insert is at least essentially vertical or, where appropriate, also horizontal or also inclined, e.g. at an angle of 45° to the horizontal.

In an advantageous embodiment of the invention, provision is made for the housing to encompass at least one door, located on the housing, for sealing off a housing opening designed as an ice cream removal opening, where the door is preferably mounted laterally in the case of a vertical axis of rotation, and preferably on the top side in the case of a horizontal axis of rotation. The door can consist of transparent material and, for instance by means of a pivoting mechanism, surround the area of the ice cream receiving compartment projecting laterally from the housing. The at least one door can be lockable. The door can be designed with one, two or multiple leaves and, independently thereof, as a revolving or swiveling door, or as a flap. The door preferably guarantees essentially air-tight sealing of the housing.

Particularly preferably, the insert can, for fitting and/or removal, be passed through a housing opening designed as an ice cream removal opening, which is preferably located laterally on the housing and/or to the side of the axis of rotation. In this context, the refrigerating device is preferably designed in such a way that fitting or removal can be accomplished without manipulating the refrigerating unit, the heat exchanger and/or other devices for supplying the ice cream receiving compartment with cooling air, such as supply lines, fans or the like. For a rapid change of ice cream types, for example, the insert can preferably be removed directly through a housing opening with out any further dismantling of the housing—but after disconnection from the drive unit, where appropriate—and/or without the help of tools.

Alternatively or additionally, provision can, according to the invention, be made for the insert to be passed through a housing opening designed as a cover for fitting or removal. Similarly, for simpler fitting and/or removal, the insert can be removed not only laterally through the housing opening designed as an ice cream removal opening, but also through a housing opening in the upper area of the housing that can be sealed with a cover. This also permits simpler loading of the refrigerating device, especially with a voluminous insert of high weight. Fitting and/or removal of the insert preferably requires only dismantling of the cover and, where applicable, disconnection of the insert from the drive unit, where the ice cream receiving compartment can be separated from the drive unit by a further cover.

In a particularly expedient embodiment of the invention, provision is made for means to be provided for interrupting the rotation of the insert, so that ice cream can be removed while the insert is stationary. The means can preferably be switched by opening the at least one door assigned to the ice cream removal opening, interrupting the rotation of the insert, although they can, where appropriate, also be switched separately, either manually or in some other manner. By means of manual operation of a three-way switch, for example, a choice can be made among the settings, such that the insert rotates continuously when the door is both open and closed, e.g. in order to be able to remove ice cream with an ice cream portioner during rotation, or that the rotation of the insert is stopped when the door is opened, or the rotation of the insert is stopped immediately by operation of the three-way switch.

The receiving volume of the ice cream receiving compartment, or of a separate segment thereof described below, is expediently 1 to 20 liters, preferably 2 to 5 liters. Ice cream of the production volume of conventional ice cream machines can, therefore, be transferred directly to the ice cream receiving compartment of the insert, where the insert is preferably capable of accommodating a complete production batch.

A particularly preferred embodiment of the refrigerating device encompasses an ice cream receiving compartment that protrudes from the housing, laterally to the axis of rotation of the insert, preferably in the area of its upper end, i.e. on the side facing away from the base of the housing. The ice cream receiving compartment particularly preferably protrudes from the housing laterally to the axis of rotation and parallel to the axis of rotation in both the upper and the lower area, or over its entire extension. As a result, the ice cream can be scraped out by means of an ice cream portioner and is particularly easily accessible without, for example, having to get near to, and possibly damaging, the heat exchanger with it. To this end, the insert can protrude laterally from the housing, at least in the area of a lower plate. In this context, the door can seal off the ice cream receiving compartment in such a way that, starting from the lower plate, the ice cream receiving compartment extends in column-like fashion towards the opposite end with an essentially constant, decreasing or increasing cross-section. The insert preferably protrudes laterally from the housing over its entire height. The door can reach around the insert on the upper and/or lower side and seal off the protruding area against the housing in essentially air-tight manner, although this can, where appropriate, also be accomplished by a plate of the insert or by a separate element.

Due to the fact that the insert protrudes laterally from the housing over part of its circumference, where the axis of rotation is expediently located in the housing, and the insert can protrude from the housing by up to ⅓ or up to ⅔ of its radius, the insert can easily be grasped, e.g. for fitting and/or removal, and thus guided precisely into and/or out of the corresponding bearing of the insert.

In a development of the invention, provision is made for the insert to be mounted, at least at one end of the axis of rotation, e.g. the end at the top during operation, in a movable holding device, so that the insert is securely mounted during rotation and can be fitted and/or removed with ease. Where appropriate, however, a holding device can also be alternatively or additionally provided at the lower end of the insert, and can be of fixed or movable design in this context.

The drive unit can be located in extension of the axis of rotation of the insert, this permitting direct power transmission to the shaft of the insert without further transmission elements, in order to cause the insert to rotate about the axis of rotation lying in the shaft. The drive unit can be disconnected from the insert simply by lifting it off. In reference to its axis of rotation, the insert is preferably installed vertically in the housing in this context, or optionally also horizontally. The drive unit is preferably located within the housing, or mounted on top of it.

According to a particularly preferred embodiment, the insert displays an upper and a lower shaft projection, where the upper or lower shaft projection of the insert can be detachably inserted into a corresponding bearing, and where the other shaft projection of the insert can be connected in detachable and positive fashion to a corresponding transmission element driven by a drive motor, so that the insert can, on the one hand, be driven via the upper bearing, for example, and is, on the other hand, mounted securely and without play. In this context, the term shaft projection is taken to mean a shaft end or an engaging element located in extension of the axis of rotation. The transmission element can be a V-belt or a toothed belt, for example. Optionally, the insert can also be driven via a gearbox, or a friction roller or a friction disk that acts on a corresponding friction edge of the insert. Alternatively, the design of the connection for acting on a shaft projection can also be inverted, such that the transmission element encompasses a shaped projection that engages a corresponding recess on the shaft end of the insert in positive fashion. Independently hereof, the opposite connection can likewise be inverted.

Manual actuating means are preferably provided for moving the transmission element and/or the bearing located opposite it for connection to and/or disconnection from a shaft end of the insert, so that separate tools can be dispensed with. The actuating means can preferably be operated from outside the housing, or after removing a cover plate, in order to disconnect the shaft and/or the shaft projections of the insert from the power transmission and/or release the same from the fixed holding device in order to fit and/or remove the insert.

The connection between the shaft and the transmission element can be disconnectable by means of axial displacement and/or lateral displacement of the transmission element, or optionally also by means of a snap-in connection or a clamp-type connection. For example, the connection existing between the insert and the transmission element can be disconnected by axial displacement of the transmission element, which is designed with one end as an actuating means protruding from the cover and with another end that can be connected positively to the shaft projection or the shaft of the insert, thus releasing the insert for fitting and/or removal.

The heat exchanger is preferably integrated in the housing, as is also the refrigerating unit, where appropriate. It goes without saying that these can each also be located outside the housing and that, where appropriate, several housings can be assigned to one heat exchanger and/or one refrigerating unit.

It is particularly advantageous that the heat exchanger surrounds the insert over part of its circumference in the housing. As a result, the ice cream accommodated in the insert can be refrigerated directly and without cooling losses, and the insert can be fitted and/or removed without handling the heat exchanger and/or the cold-air feeder from it for directing cold air to the ice cream. A lateral reach-through opening, preferably of adequate dimensions, is left in the heat exchanger for the removal of ice cream and/or for fitting and/or removing the insert in the lateral direction.

The cold air generated by the heat exchanger is preferably fed directly, particularly in the arrangement described above, but also independently of this, where appropriate through or around a shield, e.g. in the form of a shielding plate provided with air passages, onto the ice cream receiving compartment and thus onto the outside of the ice cream, without being directed through air ducts provided in the insert and/or elsewhere. A fan can also be provided for this purpose.

The heat exchanger can at least partly extend over the height of the ice cream receiving compartment and preferably end at least approximately level with an upper border of the ice cream receiving compartment in order to effectively refrigerate the ice cream present in the insert, and also the upper and lower area of the insert. The heat exchanger can display at least roughly half the height, and up to the entire height, of the ice cream receiving compartment of the insert, or extend beyond it. This results in effective refrigeration of the receiving compartment over its entire height, while permitting a simple design.

In a development of the invention, a selector switch is provided for the types of ice cream located in different segments of the insert that are laterally adjacent in relation to the axis of rotation, as described below. The selector switch can display means that selectively position every individual segment of the insert in the area of the ice cream removal opening of the housing and preferably fix the insert in this position.

Particularly advantageously, at least one fan is provided that directs at least a partial stream, or a principal stream, of the cooling air essentially horizontally around part or all of the circumference of the insert and/or essentially radially in the direction of the insert, this permitting direct, particularly effective refrigeration of the ice cream. Alternatively, a partial air stream, or a principal air stream, can be generated that is oriented essentially parallel to the axis of rotation of the insert and is directed towards the ice cream receiving compartment, preferably through air outlet openings or nozzles in the region of, or at the level of, the outer edge of the ice cream receiving compartment. It goes without saying that a fan can also be dispensed with in the presence of sufficient cooling-air currents, e.g. as a result of convection and/or as a result of sufficient rotation of the insert that distributes the cold air. In this context, a principal air stream is taken to mean an air stream whose air volume per unit of time relatively exceeds that of other air streams, or which accounts for more than 50% of the total volumetric flow.

Furthermore, and independently hereof where appropriate, the cooling air in the area of the ice cream removal opening is preferably directed, at least in a partial air stream or in a principal air stream relative to the air current in the area of the removal opening, essentially perpendicular to the axis of rotation and essentially tangential to the ice cream receiving compartment, optionally also parallel to the axis of rotation of the insert, in order to minimize the escape of cold air when the door is open. To this end, suitably positioned air outlet openings or nozzles can be located in the area of the door, e.g. laterally in the door frame or at the level of the outer edge of the ice cream receiving compartment. The partial air stream in the area of the door can display a different principal direction of flow than at a distance from the door.

The insert for the refrigerating device is expediently designed with a preferably essentially cylindrical receiving compartment for ice cream. The insert displays a shaft, or an upper and a lower shaft end. Seen in the direction of installation, one shaft area or shaft end, about which the insert can rotate, projects from the top of the ice cream receiving compartment. The insert displays at least one plate as the lower border of the ice cream receiving compartment, where the ice cream receiving compartment is filled with unwrapped ice cream, at least in the area of adjacent delimiting walls. The cooling air acts directly on the ice cream, since it can be fed directly onto the outer circumference of the ice cream. The ice cream can be removed through the housing opening or the at least one ice cream removal opening. Where appropriate, additional plates in the form of intermediate shelves can be inserted in variable numbers and at variable axial heights to serve as level dividers, where each level can be partly or completely filled with ice cream, and different types of ice cream can be filled into the various levels.

In a development of the invention, provision is made for at least two segment walls to be located on the plates to divide the ice cream receiving compartment into adjacent segments, where the segment walls can be fastened in detachable fashion, e.g. on the upper and/or lower plate. To this end, guides can be provided on the plate, e.g. in the form of laterally oriented slots with a spacing corresponding to the thickness of the segment wall, so that the segment walls can be slid in laterally between the lower and upper plates of the insert, preferably up to the centrally located shaft or until the segment walls meet. As a result, the ice cream receiving compartment of the insert can be partly or completely filled with different types of ice cream in the various segments. It is particularly expedient if 2, 3 or 4 segments are provided, without being limited to this.

In an expedient embodiment of the refrigerating device according to the invention, the insert is designed in such a way that segmental inserts can be fitted, where the segmental inserts consist of two lateral side walls, arranged at an angle to each other, and plate segments, at least at the lower end seen in the direction of installation, so that each segmental insert, which can be filled with ice cream independently of the insert, can, where appropriate, be exchanged for another segmental insert without removing and/or fitting the insert, as a result of which the insert of the refrigerating device can be refilled with ice cream of changing types without being removed and/or fitted. The segmental inserts can be filled partly or completely. The segmental inserts can, for example, be fastenable to the plate located at the bottom and/or top in the direction of installation, and/or to the shaft of the insert.

The segment walls and/or segmental inserts can be fixed in position on the insert in detachable fashion, preferably by magnetic means that hold the segment walls and/or segmental inserts in place on a plate of the insert.

The plate or plates of the insert, the segment walls and/or the segmental inserts are preferably of continuous design and preferably without undercuts. They preferably delimit the respectively assigned area of the ice cream receiving compartment completely from laterally and/or axially adjacent ice cream receiving areas or housing areas at the sides and the bottom, and preferably also at the top. Each receiving compartment defined by the lateral delimiting walls and the plate or plates is preferably completely open radially in the direction of removal of the ice cream, so that the unwrapped ice cream can fill the receiving compartment completely and be removed from this compartment without undercuts.

In a development of the invention, provision is made for the ice cream receiving compartment of the insert, and/or at least some of the receiving compartments separated from each other by segment walls and/or segmental inserts and/or plates, to be partly or virtually completely fillable with ice cream. Maximum refrigerating efficiency is obtained with a maximum load as a result of the shortest fluid communication between the ice cream and the heat exchanger.

The shaft is expediently of closed design, e.g. made of solid material, to avoid contamination in cavities when the insert is removed and, where appropriate, to obtain great stability with a relatively small cross-section.

It goes without saying that the refrigerating device according to the invention is particularly adapted to the storage and presentation of ice cream, but that it can also serve to accommodate other foods or objects.

The invention will be explained below on the basis of a practical example illustrated in the drawings.

Figure 2B:
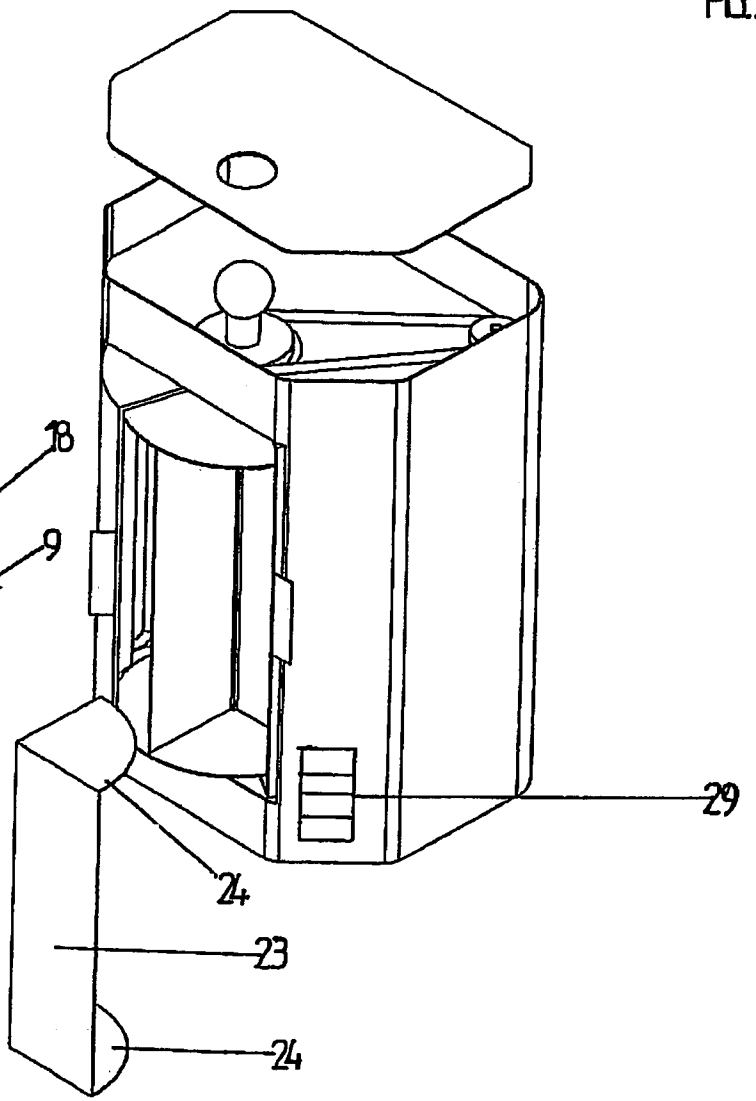
Figure 2A:
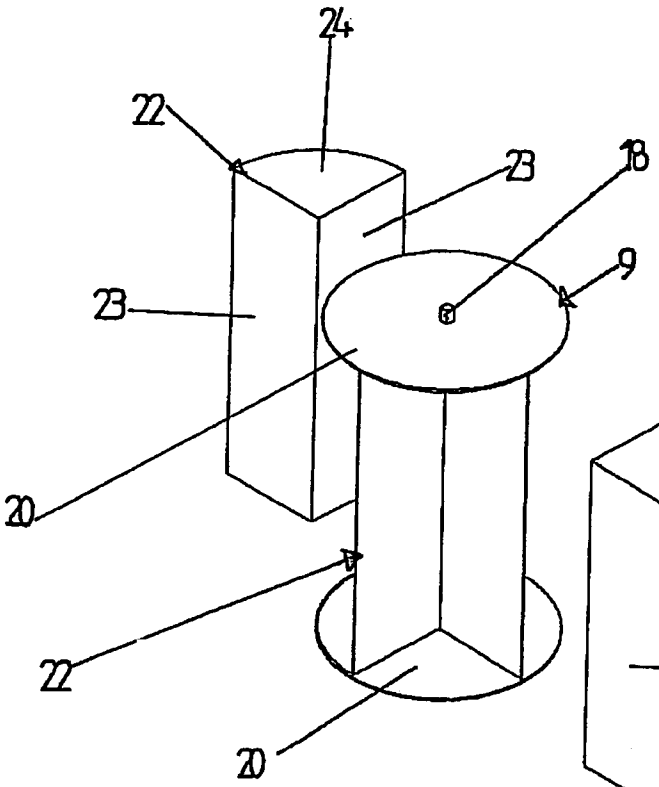
Figure 3:
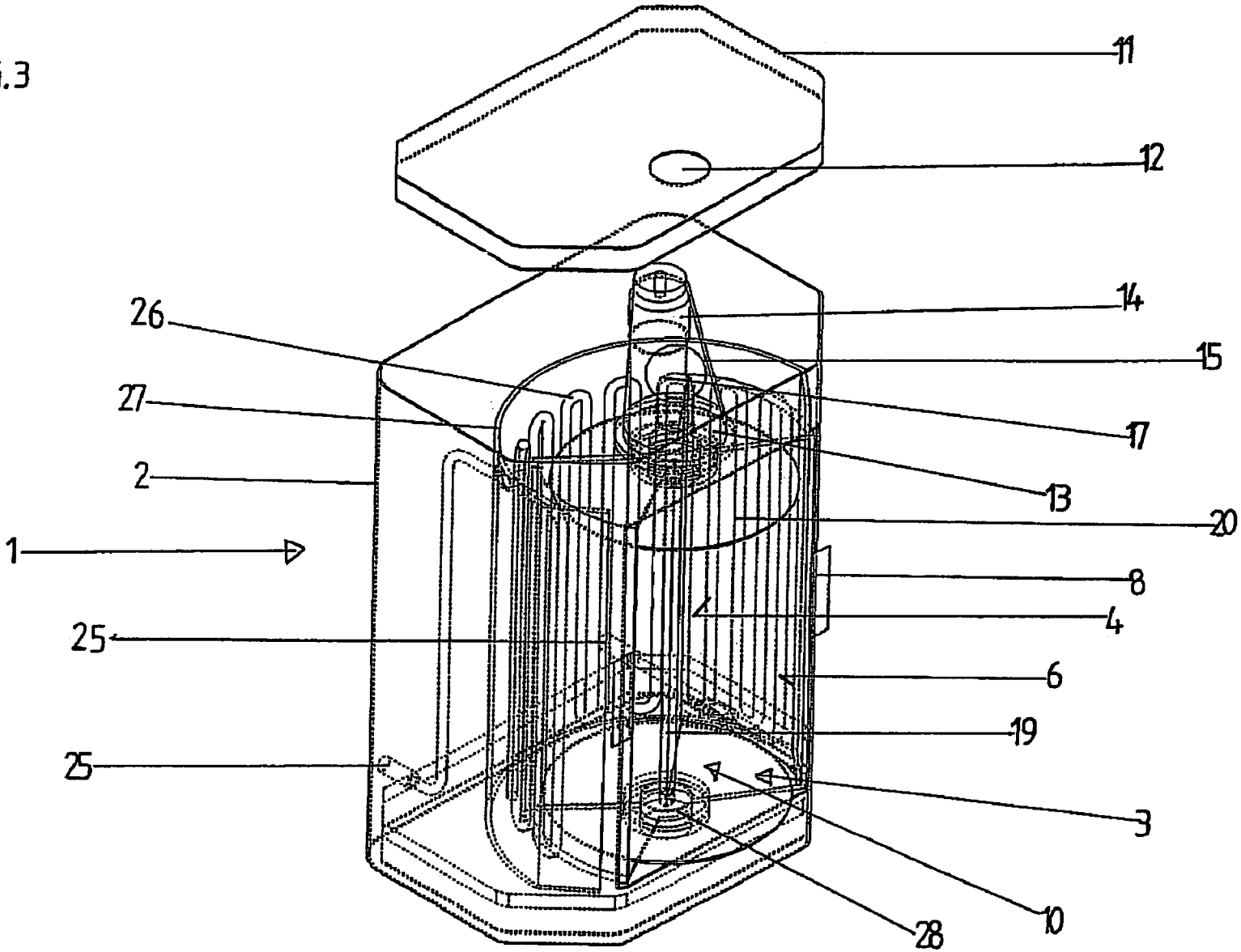
Figure 4:
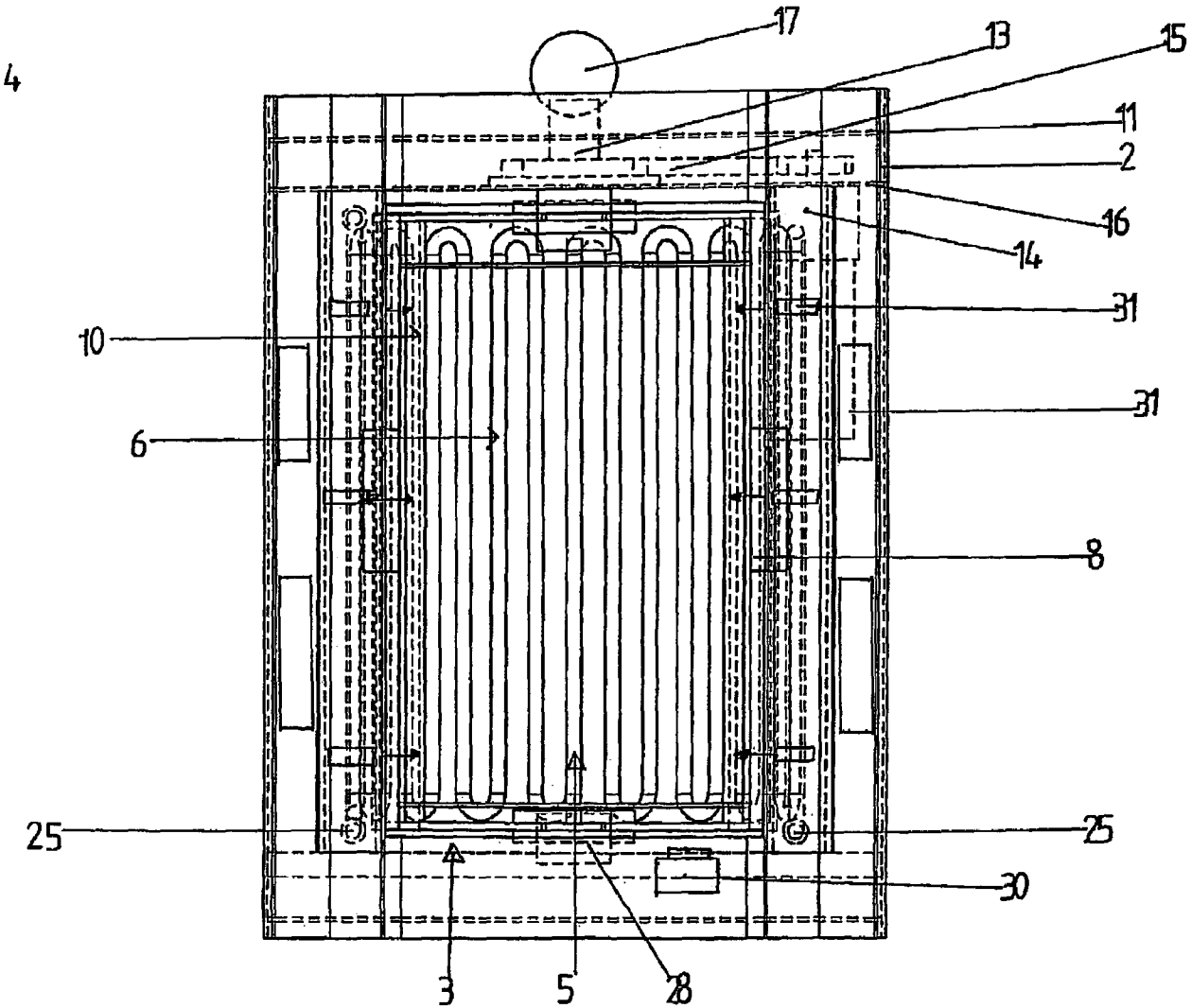

The drawings show the following:

FIG. 1 A schematic representation of a perspective view of a refrigerating device according to the invention with an insert (FIG. 1*a*) and an insert according to the invention with segment walls (FIG. 1*b*), FIG. 2 A schematic representation of a perspective view of the refrigerating device according to the invention with an insert (FIG. 2*a*) and an insert according to the invention with segmental inserts (FIG. 2*b*), FIG. 3 A section of the refrigerating device according to the invention with an insert, FIG. 4 A section of the refrigerating device according to the invention.

Pursuant to FIG. 1, refrigerating device 1 according to the invention displays a heat-insulated housing 2 with a housing opening 3 and a storage device 4 with a receiving compartment 5 for ice cream, where housing 2 essentially surrounds receiving compartment 5 completely and storage device 4 is mounted in housing 2 in rotating fashion. Housing 2 is assigned a heat exchanger 6, for generating cold air, which can be connected to a refrigerating unit 7, located inside or outside housing 2, so that the ice cream in receiving compartment 5 can be refrigerated by means of the cold air generated. Housing opening 3 is surrounded by two swiveling doors 8 that can be opened in roughly circumferential, quarter-circle movements and enclose, laterally, on the top side and on the bottom side, an area of insert 9 that projects from housing 2, thus sealing off housing 2 is essentially air-tight fashion. Insert 9 can be passed through housing opening 3, through which ice cream can also be removed, from outside in order to be fitted inside housing 2 and/or removed. In this way, insert 9 can be filled completely with ice cream outside housing 2, meaning that the full capacity of receiving compartment 5 can be utilized and that the ice cream can be presented attractively and removed rapidly.

A drive unit 14, located in an area of housing 2 facing away from door 8, is provided for driving insert 9, driving a transmission belt 15, which is designed as a first transmission element and located above an upper cover 16 of storage device 4, and a second transmission element 13, which can be moved along its vertical axis. Second transmission element 13 is designed with a handle 17 in its upper area and, in its lower area, with a recess designed as a receptacle of square shape corresponding to shaft projection 18 of insert 9.

In the upper area, housing 2 displays a removable cover 11 with an opening 12, through which transmission element 13 can be guided with handle 17, located outside housing 2, by means of which insert 9 can be disconnected from drive unit 14 for removal.

Insert 9 consists of a central shaft 19, which is designed as solid material, and a plate 20, located at each end of shaft 19, which is designed as a circular disk and is penetrated by shaft 19 in the middle, where shaft 19 protrudes from plate 20 at both ends in the form of a shaft projection 18. Four segment walls 21, with the same height as the distance between the two plates 20 of insert 9, can be slid laterally into insert 9 and arranged in magnetically fixable position in such a way that they divide ice cream receiving compartment 5 into four smaller ice cream receiving compartments between plates 20 of insert 9, displaying a width such that they do not protrude laterally beyond the edge of the lower or upper plate.

As can be seen from FIG. 2, insert 9 according to an alternative of the invention for refrigerating device 1 displays a possibility for installing segmental inserts 22 which, according to the practical example, can be slid laterally into ice cream receiving compartment 5 and magnetically fixed in position. A segmental insert 22 comprises two segment walls 21 that connect segmental plates 24, which are located opposite each other at the top and bottom and are designed as segments of a circle, thus providing an ice cream receiving compartment extending over a quadrant. Where appropriate, upper plate 24 can also be omitted. The height of segmental inserts 22 corresponds to the height of ice cream receiving compartment 5 of insert 9. According to the practical example, the volume of the ice cream receiving compartment of segmental insert 22 is approximately 2.5 liters, meaning that the total volume of the ice cream receiving compartment of insert 9 is approximately 10 liters. In both practical examples in FIGS. 1 and 2, the volume of the ice cream receiving compartment of insert 9 is the space between the two opposite plates 20 or, if upper plate 20 is omitted, for example, the space of a column with a base area defined by plate 20 that extends approximately or exactly up to the height of segment walls 21 or segmental inserts 22. The ice cream is not to be filled beyond plate or plates 20 in the radial direction because, when fitting insert 9 into refrigerating device 1, heat exchanger 6 can be contaminated with ice cream, on the one hand, and insert 9 can be prevented from rotating, on the other hand.

The ice cream receiving compartment of insert 9 is largely located in receiving compartment 5 of housing 2, such that the vertical axis of rotation of insert 9 runs through housing 2. Ice cream receiving compartment 5 projects by approximately half its radius from housing 2 through receiving opening 10. When closed, this area is completely surrounded by the two doors 8 in essentially air-tight fashion.

As can be seen from FIG. 3, refrigerating device 1 according to the invention displays a heat exchanger 6, located in housing 2, which is located around part of the circumference of the ice cream receiving compartment in housing 2 and virtually surrounds receiving compartment 5 completely, except in the area of housing opening 3. An associated refrigerating unit 7 is located outside housing 2, two connections 25 for connecting heat exchanger 6 to external refrigerating unit 7 being provided on the outside of the housing in order to enable the exchange of a fluid refrigerating medium. The height of cooling coils 26 corresponds at least to the height of ice cream receiving compartment 5 of insert 9. On the outer circumference, heat exchanger 6 is surrounded, at a small distance from insert 9, by an inner, lateral cover of the refrigerating compartment, this ending flush with housing opening 3.

As can be seen from FIGS. 3 and 4, refrigerating device 1 according to the invention displays an upper and a lower bearing 28 for receiving insert 9, where lower shaft projection 18 of insert 9 engages bearing 28, located at the bottom in receiving compartment 5, in freely rotating fashion, and upper shaft projection 18 positively engages the corresponding receptacle in transmission element 13. Insert 9 is thus driven by drive unit 14 via transmission belt 15 and transmission element 13, which can be connected to insert 9. For manual disconnection, the height of transmission element 13 can be changed by means of its handle 17, located outside housing 2, at least to such an extent that upper shaft projection 18 of insert 9 is released from the bearing of transmission element 13 and that insert 9 can subsequently be raised to such an extent that lower shaft projection 18 disengages from the lower bearing at the same time. Even in the highest position of movable transmission element 13, transmission belt 15 engages a guide located on the drive side and/or on transmission element 13, without jumping out.

For removal of insert 9, the height and width of housing opening 3 and, in particular, of reach-through opening 10 between the two open doors 8 are designed such that insert 9 can be passed through vertically.

Furthermore, several fans are provided, which are suitably distributed over the height of the housing and the circumference and which guide the stream of cooling air essentially horizontally around the circumference of insert 9 and essentially radially in the direction of insert 9, this enabling direct, particularly effective refrigeration of the ice cream, since the rotation of insert 9 already induces a sufficient cooling-air current. This air stream passes through nozzles 31 in the area of the outer edge of ice cream removal opening 10 and is directed towards doors 8 in the process. This air stream provides cooling of doors 8 when closed, on the one hand, and a cooling curtain when doors 8 are open, on the other hand. Another air stream, which is generated exclusively by a fan, is oriented essentially parallel to the axis of rotation of insert 9 and passes through air outlet openings 31 in the area of the outer edge of ice cream receiving compartment 5.

By operating selector switch 29, each of the different types of ice cream filled into the individual segments of insert 9 can be selectively positioned in the area of ice cream removal opening 10 of housing 2, and insert 9 fixed in this position. For this purpose, a switch can be located in the housing in the area of the underside of the lower plate, which can be moved into different target positions by the selector switch, each of which is assigned to a segment. Drivers can be provided on the underside of the plate, e.g. at different radial distances from the axis of rotation, each of which is assigned to a segment and can switch the switch in its respective selection position when contacted, as a result of which the drive can be stopped. For fitting the insert in the correct position, appropriate markings can be provided on the insert and the housing, or the insert and the housing, or its bearing area, can be designed such that the insert can only be fitted in a certain position relative to the switch. The selection mechanism can, of course, also be of another suitable design.

FIG. 4 moreover shows an interrupter that is coupled to the drive unit to interrupt rotation of the insert when the door is opened. The interrupter can, in particular, be provided as an alternative to the selector switch.

List of Reference Numbers

1 Refrigerating device
2 Housing
3 Housing opening
4 Storage device
5 Receiving compartment
6 Heat exchanger
7 Refrigerating unit
8 Door
9 Insert
10 Removal opening
11 Cover
12 Opening
13 Transmission element
14 Drive unit
15 Transmission belt
16 Top cover
17 Actuating means
18 Shaft projection
19 Shaft
20 Plate
21 Segment wall
22 Segmental insert
23 Segmental insert wall
24 Segmental insert plate
25 Connections
26 Cooling coils
27 Lateral cover
28 Bearing
29 Selector switch
30 Interruptor
31 Ventilation nozzles

The invention claimed is:

1. Refrigerating device for storing and presenting ice cream, with a heat-insulating housing, where the housing displays a housing opening and a storage device with a receiving compartment for ice cream, where the housing essentially surrounds the receiving compartment completely and the storage device is mounted in the housing in rotating fashion, and where a heat exchanger for generating cold air is assigned to the housing and can be connected to a refrigerating unit located inside or outside the housing, such that the ice cream in the receiving compartment can be refrigerated by the cold air generated, wherein the storage device is designed as an insert that can be fitted or removed through the housing opening or both, wherein the housing encompasses at least one lateral door for sealing off a housing opening designed as an ice cream removal opening, and wherein the insert is dimensioned in such a way that it can be passed through the oven door and wherein the insert is laterally open over its entire height.

2. Refrigerating device according to claim 1, characterized in that the insert is dimensioned in such a way that it can be passed through a housing opening designed as a cover.

3. Refrigerating device according to claim 1, characterized in that means are provided for interrupting the rotation of the insert, and in that the means can be switched by opening the at least one door assigned to the ice cream removal opening, interrupting the rotation of the insert.

4. Refrigerating device according to claim 1, characterized in that the ice cream receiving compartment protrudes laterally from the housing, at least in the area of its upper end.

5. Refrigerating device according to claim 1, characterized in that the insert protrudes from the housing wall laterally to its axis of rotation over part of its circumference.

6. Refrigerating device according to claim 1, characterized in that the insert displays axially oriented rotating areas, about which the insert can be rotated, forming an axial axis of rotation, and in that the insert is mounted, at least at one end of the axis of rotation, in a movable holding device.

7. Refrigerating device according to claim 6, characterized in that a drive unit is located in extension of the axis of rotation of the insert.

8. Refrigerating device according to claim 1, characterized in tat the insert displays at least one shaft end that can be connected in detachable and positive fashion to a corresponding transmission element driven by a drive motor, and in that manual actuating means are provided for moving the transmission element, or a bearing located opposite it, for changing the connection status of the transmission element to the shaft end of the insert, and in that the actuating means can be operated from outside the housing or after removing a cover plate.

9. Refrigerating device according to claim 8, characterized in that the connection between the shaft and the transmission element can be disconnected by moving the transmission element.

10. Refrigerating device according to claim 1, characterized in that the heat exchanger surrounds the insert over part of its circumference in the housing.

11. Refrigerating device according to claim 1, characterized in that the heat exchanger extends at least partly over the height of the ice cream receiving compartment and ends at least approximately level wit an upper border of the ice cream receiving compartment, or displays at least roughly half the height of the ice cream receiving compartment of the insert.

12. Refrigerating device according to claim 1, characterized in that a selector switch is provided for the types of ice cream located in different segments of the insert, the operation of which permits positioning of to insert in such a way that the selected type of ice cream can be removed through to removal opening, alter opening the at least one door, where appropriate.

13. Refrigerating device according to claim 1, characterized in that at least one fan circulates at least a partial stream of the cooling air essentially horizontally around at least part of the circumference of the insert or radially in to direction of the insert.

14. Refrigerating device according to claim 1, characterized in that, into area of the ice cream removal opening, at least a partial stream of to cooling air is directed essentially horizontally onto the at least one door.

15. Refrigerating device according to claim 1, characterized in that the insert displays a shall or a shaft projection, about which the insert can be rotated, and at least one plate as the lower border of the ice cream receiving compartment, and in that at least two segment walls are located on the at least one plate to divide the ice cream receiving compartment into adjacent segments.

16. Refrigerating device according to claim 15, characterized in that the segment walls can be fastened on the insert in detachable fashion.

17. Refrigerating device according to claim 1, characterized in that the insert displays a shaft or a shaft end, about which the insert can be rotated, and optionally displays lateral delimiting walls, and in that the insert displays at least two segmental inserts, each of which displays two lateral dividing walls arranged at an angle to each other, and at least one plate segment at the bottom relative to the axis of rotation, and in that the segmental inserts can be fixed in position on the insert in detachable fashion.

18. Refrigerating device for storing and presenting ice cream, with a heat-insulating housing, where the housing displays a housing opening and a storage device with a receiving compartment for ice cream, where the housing essentially surrounds the receiving compartment completely and the storage device is mounted in the housing in rotating fashion, and where a heat exchanger for generating cold air is assigned to the housing and can be connected to a refrigerating unit located inside or outside the housing, such that the ice cream in the receiving compartment can be refrigerated by the cold air generated, wherein the storage device is designed as an insert that is laterally open and that can be fitted or removed through the housing opening or both, wherein the ice cream receiving compartment protrudes laterally from the housing, at least in the area of its upper end, and wherein the insert protrudes from the housing wall laterally to its axis of rotation over part of its circumference and is laterally covered by the door.

19. Refrigerating device for storing and presenting ice cream, with a heat-insulating housing, where the housing displays a housing opening and a storage device with a receiving compartment for ice cream, where the housing essentially surrounds the receiving compartment completely and the storage device is mounted in the housing in rotating fashion, and where a heat exchanger for generating cold air is assigned to the housing and can be connected to a refrigerating unit located inside or outside the housing, such that the ice cream in the receiving compartment can be refrigerated by the cold air generated, wherein the storage device is designed as an insert that can be fitted or removed trough the housing opening or both, wherein the insert is dimensioned in such a way that it can be passed through an upper housing opening having a closure that is designed as a cover, wherein the insert is laterally open to enable removal of frozen ice cream, wherein the insert displays at least an upper shaft end and at least one lower shaft end, the upper shaft end can be connected in detachable and positive fashion to a corresponding transmission element driven by a drive motor which is arranged at the upper end of the shaft, and in that manual actuating means are provided for moving the transmission element being arranged at the upper end of the shaft for changing the connection status of the transmission element to the shaft end of the insert, and in that the actuating means can be operated from outside the housing or after removing a cover plate, so that the insert can pass through the housing opening when the cover is detached.

* * * * *

UNITED STATES PATENT AND TRADEMARK OFFICE

CERTIFICATE OF CORRECTION

PATENT NO. : 7,152,423 B2
APPLICATION NO. : 10/801094
DATED : December 26, 2006
INVENTOR(S) : Schmitz It is certified that error appears in the above-identified patent and that said Letters Patent is hereby corrected as shown below:

Col. 10, Line 19 Claim 1, line 19: After “the” delete “oven” and insert --open--.

Col. 10, Line 55 Claim 8, line 2: After “in” delete “tat” and insert --that--.

Col. 11, Line 4 Claim 11, line 4: After “level” delete “wit” and insert --with--.

Col. 11, Line 14 Claim 12, line 4: After “of” delete “to” and insert --the--.

Col. 11, Line 16 Claim 12, line 6: After “opening,” delete “alter” and insert --after--.

Col. 11, Line 21 Claim 13, line 4: After “in” delete “to” and insert --the--.

Col. 11, Line 24 Claim 14, line 2: After “that,” delete “into” and insert --in the--.

Col. 11, Line 28 Claim 15, line 2: After “a” delete “shall” and insert --shaft--.

Col. 12, Line 13 Claim 19, line 13: After “removed” delete “trough” and insert --through--.

Signed and Sealed this

Thirteenth Day of March, 2007

JON W. DUDAS
*Director of the United States Patent and Trademark Office*